United States Patent [19]

Nützel

[11] Patent Number: 4,848,052

[45] Date of Patent: Jul. 18, 1989

[54] SPACER FOR TENSION MEMBER

[75] Inventor: Oswald Nützel, Munich, Fed. Rep. of Germany

[73] Assignee: Dyckerhoff & Widmann Aktiengesellschaft, Munich, Fed. Rep. of Germany

[21] Appl. No.: 167,393

[22] Filed: Mar. 14, 1988

[30] Foreign Application Priority Data

Mar. 13, 1987 [DE] Fed. Rep. of Germany ..... 3708067
Oct. 15, 1987 [DE] Fed. Rep. of Germany ..... 3734953

[51] Int. Cl.[4] ..... E04C 5/16; E04C 5/08
[52] U.S. Cl. ..... 52/230; 52/687
[58] Field of Search ..... 52/230, 687, 223 L

[56] References Cited

U.S. PATENT DOCUMENTS 2,328,033 8/1943 Schorer ..... 52/230
3,803,785 4/1974 Finsterwalder ..... 52/230

*Primary Examiner*—John E. Murtagh
*Attorney, Agent, or Firm*—Toren, McGeady & Associates

[57] ABSTRACT

A tendon for use in prestressed concrete is made up of a plurality of individual elements such as strands of steel wire arranged in a uniform array around and spaced radially outwardly from a center point. A spacer for the tendon includes a star-shaped base formed by arms extending radially outwardly from a central part. The central part and the arms define triangularly shaped openings for receiving one or a number of the tension elements. An intermediate part is positionable within the triangularly shaped openings for separating the elements located within the opening. The intermediate parts have a radially extending web and a flange extending transversely of the web for dividing the opening into separate spaces for each tension element. During assembly, the base is inserted into the tension member for separating the tension element and then the intermediate parts are inserted for spacing the elements from one another. The spacers are intended for use at a change in direction point of the tension member and initially are assembled at a position spaced from the change in direction point and then are moved to the point.

8 Claims, 2 Drawing Sheets

FIG. 1
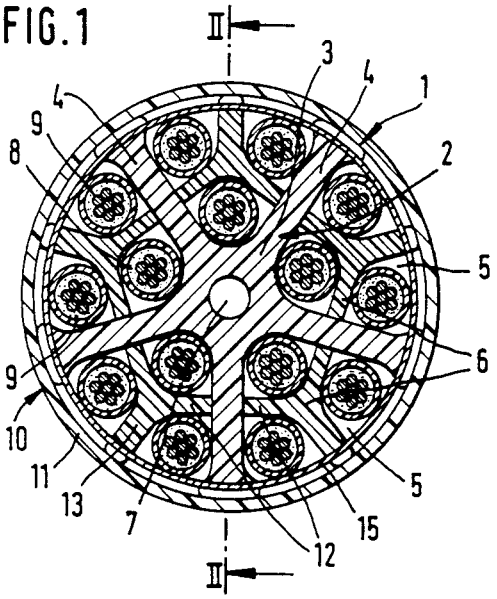
FIG. 2
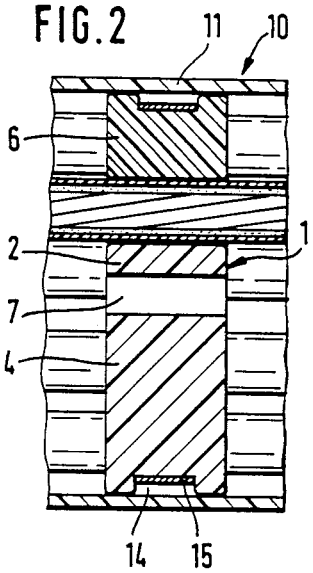
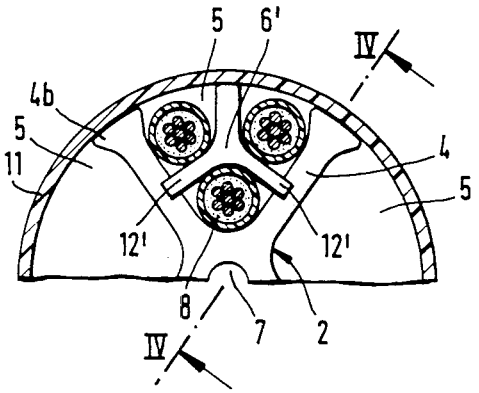
FIG. 3
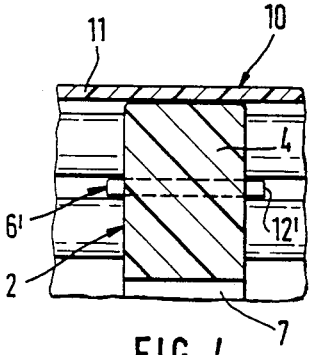
FIG. 4
FIG. 5
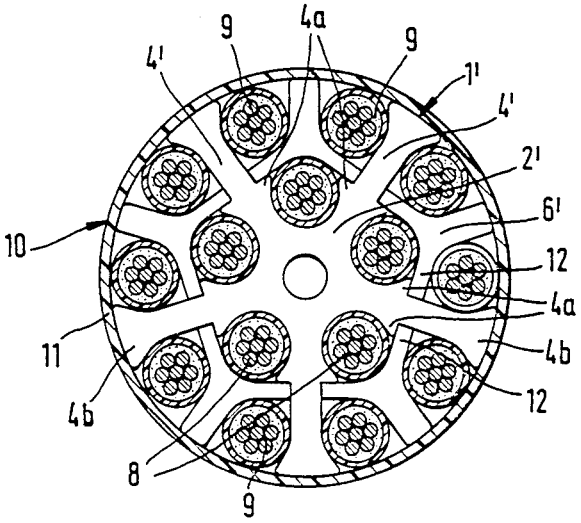

SPACER FOR TENSION MEMBER

BACKGROUND OF THE INVENTION

The present invention is directed to a spacer for a tension member, such as a tendon for prestressed concrete, diagonal cables for a stayed girder bridge or the like, where the tendon is made up of a number of spaced parallel elements, such as steel rods, wires or strands arranged spaced radially outwardly from a center point within a tubular sheathing.

In structural design, particularly of prestressed concrete bridge structures, there is a distinction in prestressing between pretensioning and post-tensioning. Pretensioning is mostly performed as prestressing with subsequent pretensioning, where the tendons remain free to move until the concrete has set and are subsequently bonded with the structure by injecting grout or cement paste. In post-tensioning, the tendons are mainly located externally of the concrete cross-section, however, they are supported with respect to the structure. They can be inspected at any time, retensioned and possibly replaced.

The placement of completely encased tendons, particularly tendon bundles is expensive and difficult because of their great weight, therefore, such tendons are often fabricated on site. Initially, the tubular sheathing is placed which consists in the free region of the tendon, mostly of a plastics material tube, for instance, a polyethylene tube and in the anchored region of the anchorage tubes, for instance, of steel tubing connected to the plastics material tube. In the next operation, the individual elements are, in turn, installed in the tubular sheathing with the help of pushing devices and the elements are anchored in the region of the anchorages. The remaining hollow spaces or cavities between the individual elements and the tubular sheathing are injected with a hardenable material, such as cement grout, in order to assure corrosion protection. If the grout is injected prior to tensioning the individual elements, the elements must be free to move to permit the tensioning operation. To afford such movement, so-called greased strands are used as the individual elements. These are strands covered with a corrosion protective mass and encased within a protective sheathing, such as polyethylene.

With tension members of this type which extend rectilinearly between anchorages, it is sufficient, as a rule, if the order of the individual elements within a bundle is observed only in the region of the anchorages. Such an arrangement can be assured by numbering the individual elements so that the order at one anchorage conforms with that at the opposite anchorage. Generally, spacers for maintaining the order of the individual elements are not required in the intermediate region between the anchorages.

In the case of tendons passing a change in direction point, for instance in the path of a tendon with post-tensioning for adapting the tendon to the path of the bending moments within the related structural member. The ordered array of the individual elements must be maintained not only at the change in direction of points but along the full tendon length, it must also be assured that the change in direction forces developed during tensioning and, of course, during the use of the structural member, are reliably transferred to the abutments or supports provided for the structural member.

SUMMARY OF THE INVENTION

Therefore, it is the primary object of the present invention to provide support for the individual tension members at a change in direction point for a tendon whereby the ordered array of the individual elements is maintained.

In accordance with the present invention, a spacer is provided formed by a approximately star-shaped base including arms extending radially outwardly from a central part. The axial length of the spacer is somewhat less than the radius of the tubular sheathing in which it is placed. The arms and the central part combine to form approximately triangularly-shaped openings for receiving at least one or a group of individual elements.

Intermediate parts are insertable into the triangularly-shaped openings for separating the individual elements into the desired ordered array. The intermediate parts are formed with at least one radially extending web for separating individual elements in the circumferential direction within the opening formed by the base of the spacer. The intermediate parts can be formed as T or Y-shaped members.

Preferably, the radial arms are provided with pads on their side faces so that flanges extending transversely of the web of the intermediate part can abut against the pads. Further, the radially outer ends of the radial arms can be widened in the form of a footing.

In a preferred embodiment, a passage can be provided through the central part of the base so that a pulling cable can be inserted through the spacer.

To secure the intermediate parts on the base, recesses are aligned with one another in the circumferential direction for receiving an annular shaped member located at the outer ends of the radial arms of the base adjacent the inner surface of the tubular sheathing and also extending across the radially outer ends of the webs of the intermediate parts. In an alternate arrangement, the opposite ends of the flanges of the intermediate parts can be longer in the axial direction of the spacer than the radial arms of the base with recesses formed in the ends of the flanges for receiving the radial arms.

One advantage of the present invention is that the spacer is constructed so that it can be asembled adjacent to the location where a tendon experiences a change in direction with the spacer being displaceable into the region of the change in direction point. With the spacer made up of several parts, it can be assembled in a building block manner in the radial direction from the center of the tendon toward the outside and also in the circumferential direction depending on the number of individual elements within the tendon.

The spacer embodying the present invention may be formed of a plastics material, such as polyethylene. The spacer acts only for maintaining the ordered array of the individual element. For transmitting redirection forces, pressure grouting at least in the region of the change in direction point is required. If the spacer is formed of metal, such as steel or cast iron or of a forging, it is possible to transmit the change in direction forces exerted at the change in direction points by the individual elements to the intermediate parts which transmit the forces directly to the radial arms of the base of the spacer. Accordingly, each individual element is supported directly so that the tendon can be tensioned prior to the grouting step.

In the placement of the tendon initially a tubular sheathing is provided with open spaces located adjacent to the change in direction points. At each change in direction point, at least one space is provided having a dimension in the axial direction of the sheathing equal approximately to the axial dimension of the spacer arrangement at the change of direction point. With the spacer located adjacent the change in direction point, the individual elements are inserted through the tubular sheathing and possibly are connected to an anchoring device. Next, the spacers are built into the tendon adjacent the change in direction point and then are moved in the axial direction into the required position at the change in direction point.

For the movement of the spacer arrangement into the change in direction point, a traction or pulling cable can be provided extending parallel to the tendon and being continuous at least up to an anchoring device.

During installation of the tendon, one of the anchoring devices at the opposite ends of the tendon is spaced at a distance from an abutment member corresponding to the spacing of the spacer arrangement for the change in direction point so that the entire tendon including the spacer arrangement can be moved in the axial direction into the change in direction point.

If plastics material spacers are used, which are unable to carry the change in direction forces, the open spaces between the individual elements of the tendon and the tubular sheathing must be grouted with a hardenable material, such as cement grout, at least in the region of the change in direction point before tensioning of the tendon is carried out and while maintaining the axial mobility of the individual elements.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings;

FIG. 1 is a cross-sectional view through a tendon and a spacer embodying the present invention;

FIG. 2 is a sectional view through the tendon and spacer taken along the line II—II in FIG. 1;

FIG. 3 is a partial cross-sectional view similar to FIG. 1, illustrating another embodiment of the spacer;

FIG. 4 is a sectional view similar to FIG. 2, taken along the line IV—IV in FIG. 3;

FIG. 5 is a view, partly in section, similar to FIG. 1, of yet another embodiment of the spacer incorporating the present invention.

DETAILED DESCRIPTION OF THE INVENTION

Figure 6:
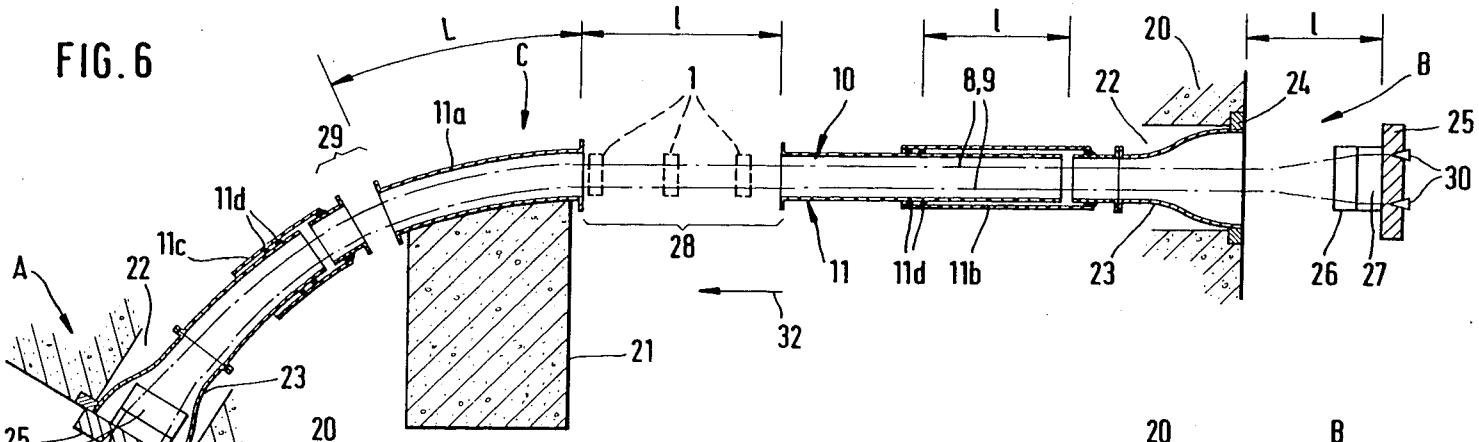
FIGS. 6 and 7 are two axially extending schematic views illustrating the installation of the spacers of the present invention, at a change in direction point of a tendon between anchorages

In FIG. 1, a spacer 1 is shown in position within a tendon 10 for maintaining the individual elements 8 and 9 of the tendon in a parallel spaced ordered array about a center point. The spacer includes a star-shaped base 2 with a central part 3, and arms 4 projecting radially outwardly from the central part. The central part and the and define a number of triangular openings 5, extending axially through the spacer, that is, in the axial direction of the tendon. An intermediate part 6 is located within each of the triangular openings 5, for dividing the opening into separate spaces for the tendon elements. The central part 3 has a central or axial passage 7. The center of the passage 7 defines the center point about which the ordered array of tendon elements are arranged.

The size and number of the radial arms 4 and the number and configuration of the intermediate parts 6 depend on the number and arrangement or ordered array of the individual elements 8, 9 of the tendon 10. The tendon is shown enclosed within a sheathing duct 11 formed of polyethylene.

As shown in FIG. 1, the tendon 10 is made up of 15 strands or individual elements. The individual elements may be greased strands. As shown, five elements 8 are arranged in an inner ring encircling the center point and ten elements 9 are located in a radially outer ring. The star-shaped part 2 has five radially extending arms 4, spaced equi-angularly apart and dividing the space into five triangular openings 5. Each opening 5 contains three elements 8, 9 located between each adjacent pair of the radial arms. Within each triangular opening 5, an intermediate part 6 divides the opening into three spaces, one radially inner space for an element 8, and two radially outer spaces, each for an element 9. As illustrated, the intermediate parts are formed as a Y-shaped member with a radially inner curved flange 12 extending transversely of a radially extending web 13. The thickness of the flange 12 and of the web 13 is a function of the required spacing between the radially inner elements 8 and the radially outer elements 9, or between the outer elements 9 from one another.

In the embodiment of FIG. 1, the spacer 1 including the base 2, and the intermediate parts 6 are formed of a plastics material, such as polyethylene which can be easily molded and does not damage the elements or strands even if uncoated strands are pulled through the spacer 1 during tensioning of the tendon. The radial dimension of the radial arms 4, and of the radial webs 13 is selected so that the entire spacer 1 can be introduced into a sheathing tube 11, and can be displaced in the axial direction of the tendon through the tube.

To assure that the base 2 and the intermediate parts 6 do not become separated during axial displacement of the spacer required for its final positioning, two different possibilities are shown in the drawing. In FIGS. 1 and 2, the radially outer ends of the arms 4 and the webs 13 are provided with recesses 14, note FIG. 2, aligned in the circumferential direction at the radially outer surface of the spacer adjacent the inner surface of the sheathing tube. A ring 15 is inserted into the recesses 14 for securing the base and the intermediate parts into a unit. In the embodiment in FIGS. 3 and 4, the flanges 12' of the intermediate parts 6' are wider or longer in the axial direction of the tendon 10 than the radial arms 4 of the base 2 against which the flanges are to rest, note FIG. 4. At the ends of the flanges 12', facing the arms 4, U-shaped recesses are formed for fitting the flanges over the opposite surfaces of adjacent arms 4 for retaining the intermediate parts 6' in position relative to the radial arms 4, and the individual elements 8, 9. The intermediate part can be slid in between two adjacent arms 4 and then fixed with respect to the base 2 in the final position as shown in FIG. 3.

Figure 7:
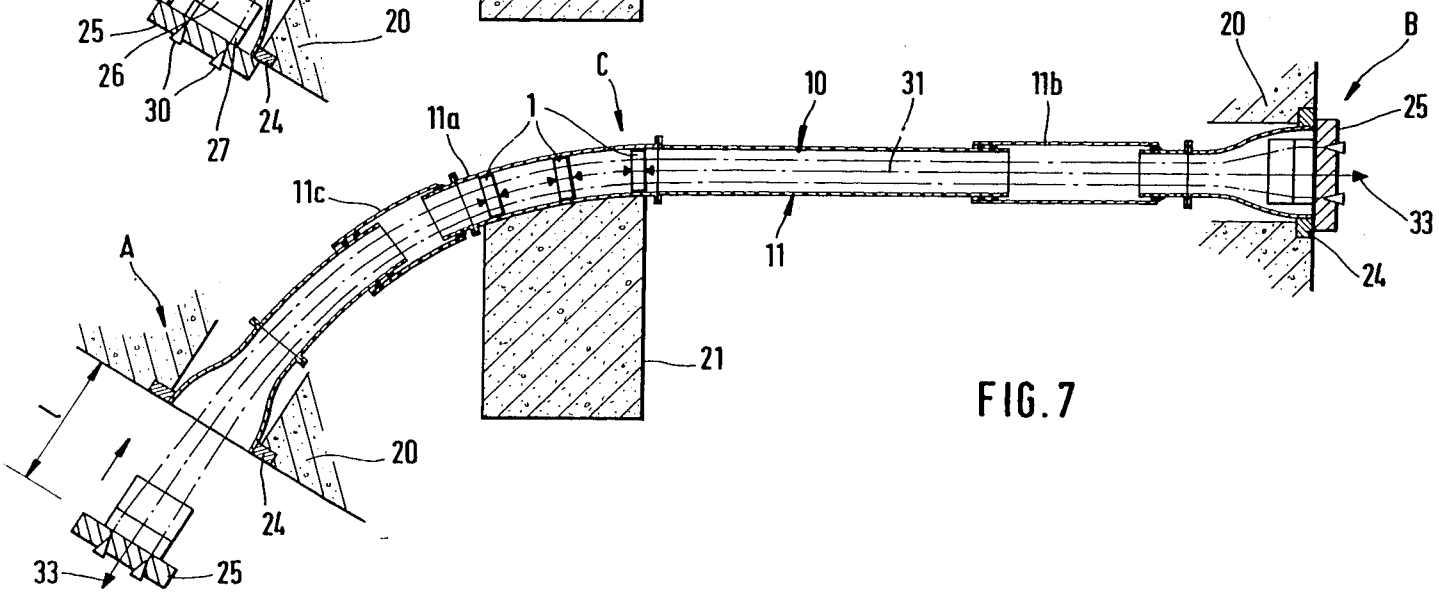

The installation of the spacer embodying the present invention in the region of the change in direction point C of a tendon is schematically shown in the illustration of a tendon with post-tensioning set forth in FIGS. 6 and 7 in two different functional states.

As can be seen in FIGS. 6 and 7, the tendon 10 extends over an abutment 21 forming a change in direction point C, located between two structural members 20, each forming an anchorage A, B for the tendon 10. As shown in FIG. 6, the ends of the tendon are spaced axially outwardly from the anchorage B, while in FIG. 7, the ends of the tendon 10 are spaced axially outwardly from the anchorage A. The structural member 20 may be a bridge girder. If the structural member is a bridge girder, the abutment or support 21 may be in the form of a pier or pylon projecting upwardly from the bridge girder web. A corresponding change in direction point would be possible in a stayed girder bridge at the change in direction of the diagonal cable over the top of a pylon.

The design of the anchorages A, B does not form a part of the present invention. Accordingly, only a recess 22 is schematically indicated into which an anchoring tube 23 is inserted along with an abutment member 24 at the outer surface of the structural member 20. The ends of the tendon extend through an anchorage disc 25 which, in position, presses against the abutment member 24. The inner side of the anchorage disc 25 has an anchor bowl 26 to be filled with a corrosion protective mass and a spacer 27 formed of polyethylene. Basically, both anchorages A, B are designed in a similar manner.

The tubular sheathing 11 is made up of prebent steel tubes 11*a*, positioned in the region of the change of direction point C. Steel tube 11*a*, as well as the anchorage tube 23, are, as a rule, installed first. Subsequently, the section of the sheathing 11 therebetween are installed. While placing the sheathing, intermediate spaces 28, 29 extending in the axial direction of the tendon are left open on one or on both sides of the change of direction point C. These spaces are provided by arranging sheathing section 11*b* and 11*c* telescoping the other installed sheathing sections. Accordingly, access is available to the tendon in the axially extending region of the open spaces 28, 29. The sheathing sections 11*b*, 11*c* can be displaced axially along the sheathing 11 for closing off the open spaces. Note, both of the sheathing sections 11*b*, 11*c* have sealing rings 11*d*, located between them and the sheathing for providing a sealed closure for the sheathing so that subsequently grout can be injected into the entire tendon. As shown in FIG. 6, the open space 28 has a dimension 1, while the sheathing section 11*a* has an axial dimension L. The axial length of the dimension 1 corresponds to the axial length of the dimension L, measured along the arc of the change in direction point C, that is the length of the sheathing section 11*a*.

The individual elements 8, 9 of the tendon 10, starting from one anchorage are displaced through the prepared sheathing 11 and are connected to the anchorage discs 25 at the anchorages A and B. If strands are used as the individual elements 8, 9, multipart annular wedges 30 serve as anchors Next, spacers 1 are assembled in the axially extending region of the open space 28 at a predetermined axial spacing from one another. The flexibility of the individual elements 8, 9 is such that the star-shaped base 2 is positioned or centered within the tendon for separating the individual elements into the openings 5. Subsequently, the intermediate parts 6 are inserted into the openings 5 from the side for spacing the individual elements within the openings. The spacers 1 are connected to one another by a pulling cable 31, note FIG. 7, which passes through the central passage 7 in the base 2. The pulling cable 31 extends between the two anchor discs 25 and passes outwardly from the discs.

In the procedure shown in FIGS. 6 and 7, in FIG. 6 the anchor disc 25 of anchorage B, is positioned at a distance 1 from the abutment member 24 and the distance 1 corresponds to the axial length of the change in direction point C. After installing the spacers 1 within the open space 28, the entire tendon bundle is displaced in the axial direction of the arrow 32, note FIG. 6, until the assembly of spacers 1 arrive at the predetermined position in the region of the change of direction point C above the abutment 21 (note FIG. 7) with the spacers located in the arcuate length of the sheathing section 11*a*. The spacers are interconnected with one another and with the tendon so that they do not change position when they are moved from the location shown in FIG. 6 to that shown in FIG. 7. It is possible, however, to make fine adjustments in both directions which can be effected at the anchorages, note the arrows 33 in FIG. 7, by means of the pulling cable 31. In the final condition of the anchor disc 25, at the anchorage A, note FIG. 7, the disc is spaced at a distance 1 from the abutment member 24. Subsequently, the disc can be pushed in the direction of the arrow into contact with the abutment member 24. The extension of the tension bundle from the anchor disc can be used for applying a tensioning jack, not shown.

It is also possible to install the two anchor discs 25 in their final position. The spacers 1 are located in the same manner as described above in the open space 28 and the movement of the spacer is effected by a pulling cable 31, whereby the assembly of spacers 1 are displaced relative to the tendon bundle made up of the individual elements 8, 9.

Since plastics material spacers are unable to transmit the change in direction forces developed during the tensioning of the tendon 10 relative to the abutment 21, the axially extending region of the change in direction point C must be first injected with a hardenable material, while maintaining the axial mobility of the individual elements. Accordingly, the hollow space located between the outermost spacers 1 and the opposite ends of the steel sheathing tube section 11*a* are closed relative to the adjacent open spaces 28, 29 by plugs of hardenable material and the remaining hollow spaces or cavities within the sheathing section 11*a* are filled with a hardenable material, such as cement grout, by injecting and venting lines, not shown, connected to the steel sheathing tube section 11*a*.

After the tubular sheathing 11 is closed by axially displacing the sheathing sections 11*b*, 11*c*, the amount of travel must correspond to the axial length of the open space 28 or 29. A connection of the separate parts of the sheathing 11 to one another can be achieved by the schematically indicated flanges and bolts, so that, finally, the injection of any remaining hollow spaces within the sheathing can be filled with hardenable material. Due to the make-up of the spacers 1 from a base 2, and intermediate parts 6, sufficient openings remain so that a hardenable material can be injected through the spacer or several spacers.

Another embodiment of a spacer incorporating the present invention is displayed in FIG. 5 in transverse cross-section through a tendon such as shown in FIG. 1. In FIG. 5, spacer 1′ has a base 2′ with angularly spaced radial extending arms 4′ and intermediate parts 6′, all formed of metal. Steel or cast iron, such as spheroidal cast iron can be used for the spacers with the intermediate parts formed a forged members.

Radial arms 4' of the base 2' have supports 4a, projecting from both sides of the arm at their radially inner ends and the supports bear against the flanges 12 of the intermediate parts 6'. During tensioning of the individual elements 9, located in the upper region of the cross-section of a bundled tendon utilizing such spacers, the radially arranged change in direction forces, exerted by the individual elements at the change in direction points are transmitted by the intermediate parts 6' and their flanges 12 directly to the pads or support 4a of the radial rams 4' of the base 2 and are passed to the structural member at the contact point in the lower region of the cross-section of the tendon. The individual elements 8 located radially inwardly from the elements 9 remain free from the constraining tensions of the elements 9, located outwardly from them. If the exterior sheathing of the tendon is formed of a sheathing tube 11 of a plastics material, such as polyethylene, it is desirable to form the radially outer end of the arms 4' with widened footing-like sections for distributing the change of direction forces along the circumference of the sheathing tube across a larger surface.

It is possible with this arrangement of the spacer to apply an intermediate prestress or the entire prestress to the tendon without first injecting a hardenable material into any intermediate regions. The injection of any hollow spaces can be performed at one time after the tensioning or prestressing.

While specific embodiments of the invention have been shown and described in detail to illustrate the application of the inventive principles, it will be understood that the invention may be embodied otherwise without departing from such principles.

I claim:

1. Spacer for an axially elongated tension member, such as a prestressed concrete tendon, a diagonal cable for a stayed girder bridge or the like, the tension member comprising a plurality of individual tension elements, such as steel wires, rows or strands, extending in the axial direction of said tension member and disposed in spaced parallel relation in an ordered array with certain tension elements disposed radially outwardly from other tension elements and the tension elements located within an axially extending tubular sheath having an inside surface, wherein the improvement comprises a star-shaped base comprising a central part and a number of angularly spaced arms extending radially outwardly from the central part, said central part and arms having a length in the radial direction of said tubular sheath slightly smaller than the radius of the inside surface of said sheath, said central part and said arms forming triangular shaped openings extending in the axial direction of the sheath for receiving at least one of said tension elements and said arms having radially outer ends with said outer ends being circumferentially spaced apart so that said openings are open at the radially outer ends of said arms, a plurality of said individual tension elements located within each of said triangular openings and including at least one said other tension element and at least two said certain tension elements, intermediate parts separate from said base and each located within one of said triangular openings for spacing said individual tension elements therein, said intermediate parts comprising a flange extending in the circumferential direction for spacing apart said certain and said other individual tension elements in the radial direction and at least one web extending radially outwardly from said flange for spacing said certain individual tension elements apart in the circumferential direction.

2. Spacer, as set forth in claim 1, wherein said intermediate parts have a T-shaped cross-section extending transverse of the axis of said sheathing.

3. Spacer, as set forth in claim 1, wherein said intermediate parts have a Y-shaped cross-section extending transversely of the axis of said sheathing.

4. Spacer, as set forth in claim 1, wherein said radial arms of said base have pad-like supports at their radially extending sides at the radially inner parts of said arms and the flanges of said intermediate parts bear against said pad-like supports.

5. Spacer, as set forth in claim 4, wherein the radially outer ends of said radial arms have an increased dimension in the circumferential direction relative to the radially inner part of said arms.

6. Spacer, as set forth in claim 1, wherein said base has said central part located radially inwardly from said radial arms has a passage therethrough extending in the axial direction of said sheathing.

7. Spacer, as set forth in claim 1, wherein circumferentially extending recesses are formed in the radially outer ends of said radial arms and of said webs and a ring-like member encircling the radially outer ends of said arms and said webs and seated within said recesses for securing said base and said intermediate parts together as a unit.

8. Spacer, as set forth in claim 1, wherein said flanges have a dimension in the circumferential direction greater than the circumferential spacing of said radial arms at the location of said flanges and said flanges having recesses therein extending in the axial direction of said sheathing and shaped to receive the adjacent surfaces of said radially extending arms.

* * * * *